US006684509B1

(12) United States Patent
Best et al.

(10) Patent No.: US 6,684,509 B1
(45) Date of Patent: Feb. 3, 2004

(54) DRY SHAVING APPARATUS

(75) Inventors: Bernhard Best, Kronberg (DE); Ingeborg Gudat, Frankfurt (DE); Rainer Ontl, Landsberg/Lech (DE); Matthias Wetzel, Schöneck-Büdesheim (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/673,410

(22) PCT Filed: Feb. 17, 1999

(86) PCT No.: PCT/EP99/01051

§ 371 (c)(1),
(2), (4) Date: Oct. 17, 2000

(87) PCT Pub. No.: WO99/59781

PCT Pub. Date: Nov. 25, 1999

(30) Foreign Application Priority Data

May 16, 1998 (DE) ..... 198 22 094

(51) Int. Cl.[7] ..... B26B 19/10
(52) U.S. Cl. ..... 30/43.92; 30/34.1
(58) Field of Search ..... 30/34.1, 43.92, 30/346.51, 223, 225, 43.91

(56) References Cited

U.S. PATENT DOCUMENTS 2,262,388 A * 11/1941 Dalkowitz ..... 30/43.92
2,326,192 A * 8/1943 Andis et al. ..... 30/43.92
3,827,144 A * 8/1974 Arpino ..... 30/43.92
4,803,780 A * 2/1989 Locke et al. ..... 30/34.1
5,423,125 A * 6/1995 Wetzel ..... 30/34.1
5,669,138 A * 9/1997 Wetzel ..... 30/43.92
5,802,932 A * 9/1998 Vankov et al. ..... 30/43.92
5,893,211 A * 4/1999 Hotani ..... 30/43.92
5,909,929 A * 6/1999 Chen ..... 30/43.92
5,946,806 A * 9/1999 Watanabe et al. ..... 30/43.92
6,082,005 A * 7/2000 Tezuka ..... 30/43.92
6,223,438 B1 * 5/2001 Parsonage et al. ..... 30/43.92

FOREIGN PATENT DOCUMENTS

| | | |
|---|---|---|
| DE | 82 27 546.7 | 3/1983 |
| DE | 37 43 181 A1 | 7/1988 |
| DE | 43 12 060 C1 | 6/1994 |
| DE | 196 33 824 C1 | 6/1997 |
| DE | 197 22 149 A1 | 12/1997 |

* cited by examiner

*Primary Examiner*—Stephen Choi
(74) *Attorney, Agent, or Firm*—Fish & Richardson PC

(57) ABSTRACT

A shaving apparatus includes a short-hair cutter unit and a long-hair cutter unit. The long-hair cutter unit includes an outer cutter with slits and segments and an inner cutter that is movable in a vertical direction by means of a carrier structure. The outer cutter has comb elements that are associated with the comb elements of a threader comb. The comb elements of the threader comb are movable jointly with the comb elements of the outer cutter in a vertical direction.

20 Claims, 5 Drawing Sheets

DRY SHAVING APPARATUS

TECHNICAL FIELD

This invention relates to a dry shaving apparatus.

BACKGROUND

From DE 197 22 149 A1 there is known a dry shaving apparatus in which threader combs having comb elements are secured to the longitudinal sides of the shaving head frame, and two short-hair cutter units and two long-hair cutter units are floatingly mounted inside the shaving head frame. The outer cutters of the two long-hair cutter units which are of a U-shaped configuration having slits and segments are each arranged along an outer side of a short-hair cutter unit, which outer side faces the shaving head frame. The slits extending transversely to the longitudinal direction of the outer cutter are of wedge-shaped construction with a larger opening width on the outer side facing the shaving head frame and a smaller opening cross section on the inner side facing the outer cutter of the short-hair cutter unit. Forming the slits like this in the outer cutter enables hairs to penetrate the cutting area only in a direction of movement from the shaving head frame to the short-hair cutter unit but not in the opposite direction of movement. Hence the known dry shaving apparatus makes provision for a long-hair cutter unit on each outer side, facing the shaving head frame, of a short-hair cutter unit in order to cut long and short hairs in opposing directions of movement such as typically occur with dry shaving apparatuses.

It is known from DE 37 43 181 A1 to allocate two hair cutter units constructed as trimmers to a short-hair cutter unit of a dry shaving apparatus in order to cut both long and short hairs in opposing directions of movement of the shaving head over the skin. A skin guiding element or a skin tensioning element is associated with, and spaced a certain distance from, the cutting teeth of the respective trimmer, which for trimming purposes are constructed with sharp edges. This predetermined spacing ensures that the cutting teeth make contact with the tensioned skin in order to cut off longer hairs at the skin surface. In use of a dry shaving apparatus of this type it will be noted that the preceding skin guiding elements do not protect the skin from coming into contact with the sharp cutting edges of the cutting teeth in the provided trimming devices. Hence injuries to the skin are not ruled out.

It is known from DE 196 33 824 C1 to associate a spring-mounted guard element with an adjustably mounted trimmer unit so that in a position of use the cutting edge of the trimmer's cutting teeth can be covered by the guard element.

From DE 82 27 546 U1 there is known a dry shaving apparatus with a housing and a shaving head frame, in which provision is made for a single short-hair cutter unit and a single long-hair trimmer unit of essentially U-shaped construction on an outer side of the short-hair cutter unit.

SUMMARY

It is an object of the present invention to provide an economically priced dry shaving apparatus with which both long hairs and shorts hairs are guaranteed to be cut, also during opposing directions of movement of the dry shaving apparatus over the area of skin needing to be shaved, without having to take skin irritations into the bargain.

This object is accomplished in accordance with the invention by the features of claim 1.

An essential advantage of the present invention lies in its reduction of the number of cutter units to a minimum whilst guaranteeing optimum usage of the various configurations of cutter units in the respective directions of movement of the shaving head of the dry shaving apparatus over the area of skin needing to be shaved. Optimum feeding of long hairs and outstanding protection of the skin in the respective directions of movement of the essentially U-shaped outer cutter over the skin are achieved by the combination of the comb elements protruding on both longitudinal sides of the outer cutter beyond its longitudinal side walls with further comb elements provided at the threader combs and associated with the previously mentioned comb elements.

These comb elements provided on both longitudinal sides of the long-hair cutter unit and acting as a hair threader device enable the long-hair cutter unit and the short-hair cutter unit to be arranged on an essentially common horizontal plane in order to perform a skin-friendly combination shave.

Proceeding from this horizontal plane, which is of particular advantage for a combination shave, the floating arrangement of the long-hair cutter unit with all the comb elements in the shaving head frame guarantees a continuous adaptation of the long-hair cutter unit to the contours of the area of skin needing to be shaved while at the same time ensuring that long hairs are combed in and cut on both sides with the skin protected. This applies equally to shaving heads of dry shaving apparatuses whose short-hair cutter unit is both immovably and floatingly mounted in the shaving head frame.

In accordance with a structurally simple embodiment of the present invention, the threader combs are provided on a carrier structure of the U-shaped outer cutter.

According to an embodiment of the present invention affording high economy of manufacture, the long-hair cutter unit with the comb elements is a ready-to-install module adapted to be coupled to the carrier structure provided with threader combs. A price advantage is to be derived also from the use of a complete long-hair cutter unit that already exists or can be used elsewhere, consisting of an outer cutter, an inner cutter with coupling element and an inner cutter pressure spring—see DE 43 12 060 C1—in combination with a carrier structure having threader combs, by means of which the joint floating movement in the shaving head frame can be effected.

The threader combs are formed preferably by two walls extending parallel to each other in longitudinal direction and having comb elements integrally formed thereon.

According to a preferred embodiment of the present invention, the walls are connected at their respective ends in longitudinal direction by means of a cross wall. As a further aspect of this embodiment, the long-hair cutter unit equipped with comb elements is provided between the parallel walls. The capsule-type housing form of this embodiment is particularly suitable for accommodating and securing a complete long-hair cutter unit equipped with two rows of threader elements.

The housing sleeve, open in opposite direction to the two rows of combs, enables the inner cutter of the long-hair cutter unit to be coupled to a drive element of the electric drive mechanism of the dry shaving apparatus by the simple means of a coupling element acted upon by a spring element.

To ensure an excellent cooperation of the long-hair cutter unit, the comb elements and the short-hair cutter unit, cooperating guide elements are provided on the carrier structure and the shaving head frame to control the vertical mobility of the long-hair cutter unit and the comb elements.

According to a preferred embodiment of the present invention, the carrier structure is movable against the spring force of at least one spring element. A simple and therefore economical embodiment provides for the spring element to be disposed in a coupling element adapted to couple the electric drive mechanism with the inner cutter of the long-hair cutter unit.

In accordance with a further embodiment of the present invention, the spring element is disposed between the carrier structure and the shaving head frame.

Excellent protection of the skin is achieved in accordance with the invention by having the outer contour of each comb element of a threader comb blend with the outer contour of the respective neighboring comb element of the outer cutter. According to yet another embodiment of the present invention, the comb elements of the threader comb are provided underneath the comb elements of the outer cutter. In a further advantageous embodiment of the present invention, the comb elements of the threader comb are positioned in front of the comb elements of the outer cutter.

Protection of the skin is enhanced by the invention by having the comb elements of the threader comb rounded off in the area of their skin-engaging surfaces. A further advantage results from the invention by providing for a smooth transition from the outer surfaces of the comb elements of the threader comb to the comb elements of the outer cutter.

In accordance with a preferred embodiment of the present invention the threader comb is equipped with a coarse comb tooth setting and, in a further aspect of this embodiment, the outer cutter is equipped with a close comb tooth setting of the comb elements. This construction of the comb teeth and their relative arrangement serves, in conjunction with the floating mobility of the long-hair cutter unit, to effect an optimum interception, alignment and feeding of long hairs into the cutting area of the long-hair cutter unit, while at the same time protection of the skin is assured by the rounding off of all those edges of the comb elements making contact with the skin.

In a further embodiment of a dry shaving apparatus of the present invention, provision is made for the long-hair cutter unit to be able to be switched on in two positions provided at relative opposite ends and to be switched off in an intermediate position. With such an embodiment it is preferable for the long-hair cutter unit to be floatingly mounted when in a position essentially coincidental with the height of the short-hair cutter unit. A further advantage arises from such an embodiment in that the long-hair cutter unit can be switched on and locked in a position opposite to that of the short-hair cutter unit. Starting the long-hair cutter unit equipped with comb elements according to the invention in two positions located at relative opposite ends guarantees an optimum combination shave by the floating long-hair cutter unit and the short-hair cutter unit in the one position and, in the opposite position, a shave with the short-hair cutter unit unimpairable by the long-hair cutter unit. Such a shave is desired by wearers of more or less long beards in order to shorten those hairs which lie outside a trimmed contour close to the remaining beard. Should one or more long hairs of the bearded user get into the long-hair cutter unit during such a shave, this hair will be cut by the long-hair cutter unit activated in this position. Wedging and hence painful tugging of the hair is thus prevented.

A trimmer unit is provided on the housing in addition in order to enable the trimming of hair contours with the dry shaving apparatus.

BRIEF DESCRIPTION OF DRAWINGS

An embodiment of the present invention will be explained in more detail in the following with reference to the accompanying drawings. In the drawings.

DETAILED DESCRIPTION OF DRAWINGS

Figure 1:
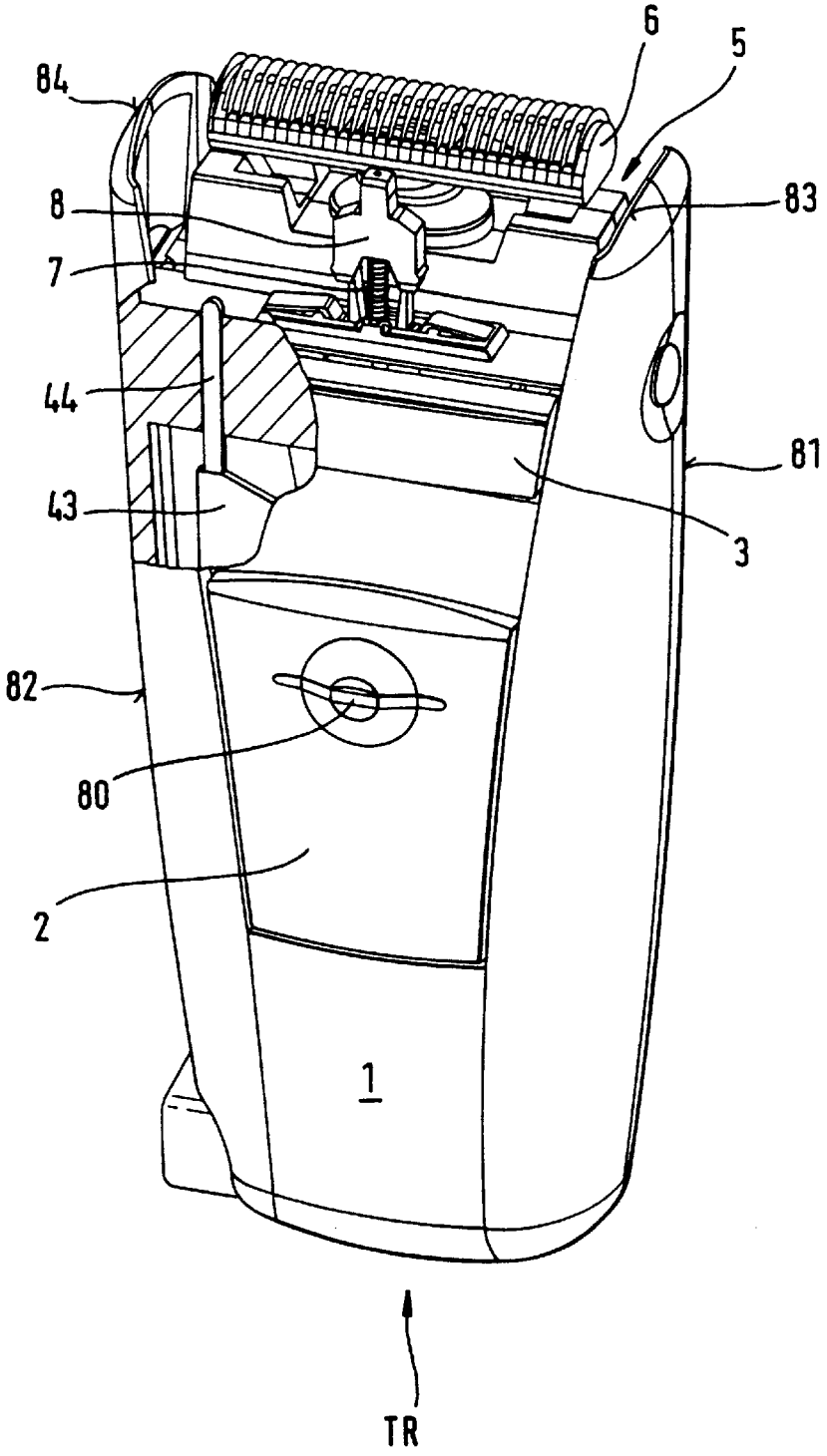
FIG. 1 is a perspective view of a dry shaving apparatus with the shaving head removed, showing a partial section through a housing wall and through a trimmer unit.

FIG. 1 shows a dry shaving apparatus TR having an actuating switch 2 with a latching switch 80 and a trimmer unit 3 adjustably mounted in its housing 1. The trimmer unit 3 is comprised of a stationary toothed comb and a toothed blade mounted for oscillatory movement. The trimmer unit 3 is pivotally arranged, for example, above the actuating switch 2 on the housing 1.

Figure 2:
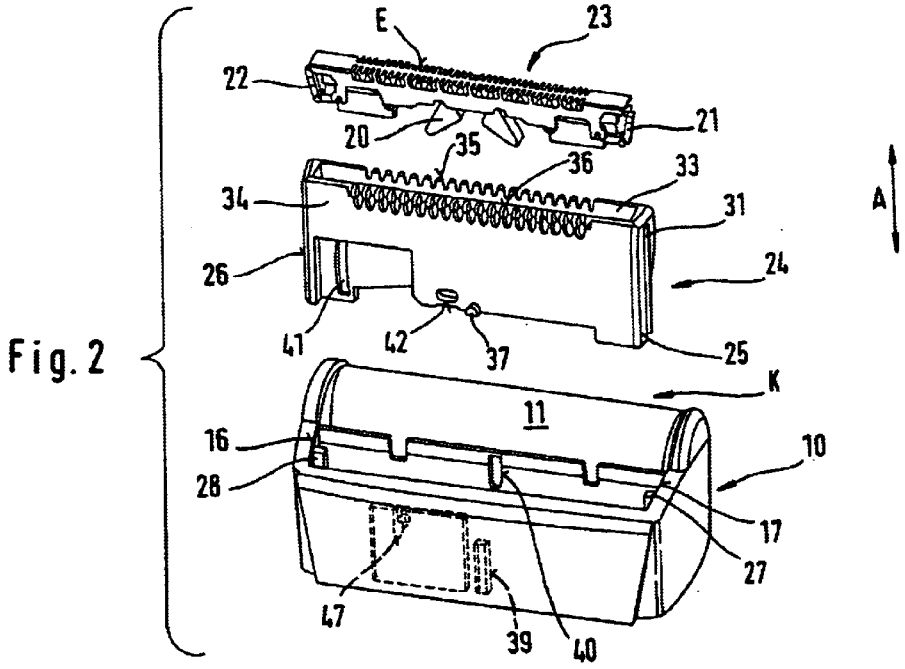
FIG. 2 is an exploded view of the upper half of a dry shaving apparatus, showing the shaving head removed.

The inner cutter 6 of a short-hair cutter unit K, which extends parallel to the upper housing side 5, and the coupling element 8 for the long-hair cutter unit 23, which is exposed to the action of a spring element 7—see FIG. 2—are coupled with an electric drive mechanism provided in the housing 1.

The housing 1 is made of two housing shells 81, 82, for example. The shaving head frame 10—see FIG. 2—is adapted to be mounted on the upper housing side 5 between two end walls 83, 84 provided on the housing 1 and to be coupled with the housing 1. FIG. 1 and FIG. 2 show a partial section above the actuating switch 2 through the housing shell 82 of the housing 1 and through the trimmer unit 3 so that a push-rod 44 guided in the housing shell 82 and projecting out of the upper housing side 5 is visible. The push-rod 44 is coupled with an actuating switch, for example actuating switch 2, via a control plate 43 and further control elements in order to adjust in a vertical direction—direction of arrow A—the carrier structure 24 with the long-hair cutter unit 23 provided inside in at least two different positions relative to the short-hair cutter unit K.

Further details of the embodiment of the shaving head of the dry shaving apparatus TR and particularly of the shaving head frame 10, which is adapted to be mounted on the upper housing side 5, together with the short-hair cutter unit K provided inside and the long-hair cutter unit 23 and the carrier structure 24 will become apparent from the exploded view of FIG. 2 and will be explained in more detail in the following.

The outer cutter 11 of the short-hair cutter unit K associated with the inner cutter 6 is comprised of a shaving foil, for example, which is clamped in arched form in the shaving head frame 10. The shaving head frame 10 with the outer cutter 11 and the long-hair cutter unit 23 is adapted to be detachably coupled with the housing 1 by means of a latching device 13 provided on the end panels of the housing 1.

Figure 3:
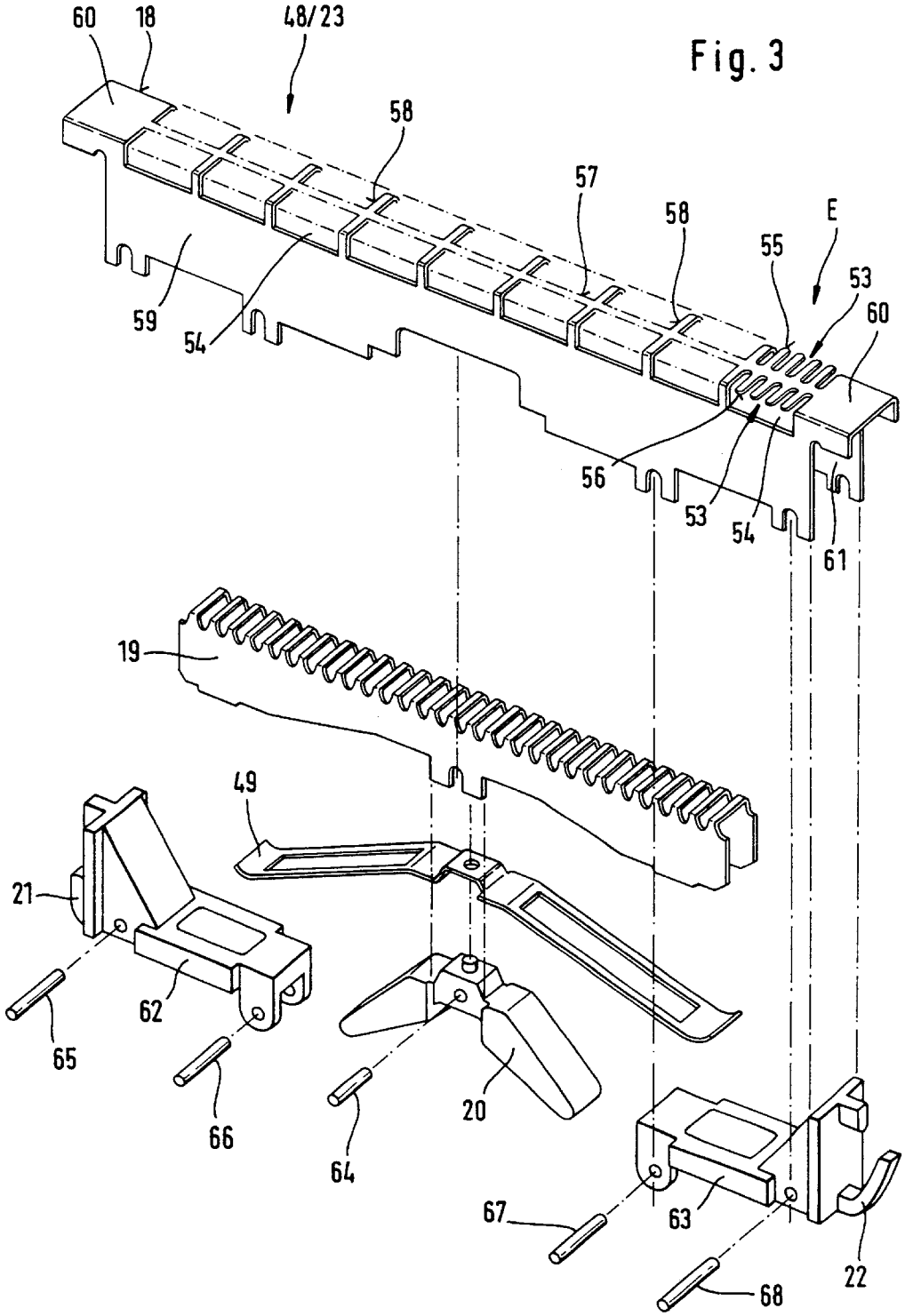
FIG. 3 is an exploded view of the components of a long-hair cutter unit.

A long-hair cutter unit 23 formed from an outer cutter 18, an inner cutter 19—see FIG. 3—and a coupling element 20 is adapted to be inserted in a carrier structure 24 and is retained therein by means of a fastening element 21 and 22. The long-hair cutter unit 23 combines with the carrier structure 24 to form an assembly to the effect that the carrier structure 24 and the long-hair cutter unit 23 are mounted for joint reciprocating movement in a vertical direction—direction of arrow A. For this purpose, guide grooves 31, 32 are provided on the cross walls 25 and 26, for example—see FIG. 6—, and guide elements 27, 28 are provided on the inner end walls 16 and 17 of the end panels of the shaving head frame 10. The floating movement of the carrier structure 24 and the long-hair cutter unit 23 provided in vertical direction—direction of arrow A—is controlled by the engagement of control cams 37 and 38 in control elements 39, 40 and limited by the selected length of the control elements 39, 40 formed as vertically extending control slots. In the embodiment of FIG. 1 and FIG. 2, the carrier structure 24 and the long-hair cutter unit 23 are movable back and forth in a vertical direction—direction of arrow A—against the action of the spring element 7.

Such a floating movement of the carrier structure 24 and the long-hair cutter unit 23 can also be effected by a different spring arrangement, for example, by the arrangement of two spring elements bearing with one end against a wall of the shaving head frame 10 and with the other end against a wall of the carrier structure 24—not illustrated. Comb elements 35 and 36 with a coarse tooth setting compared to the fine tooth setting of the comb elements E—see FIG. 3—of the long-hair cutter unit 23 are provided on the longitudinally extending walls 33 and 34 of the carrier structure 24. Integrally formed on the walls 33 and, 34 are control cams 37 and 38—see FIG. 5—which, cooperating with the control elements 39 and 40, are used for controlling and guiding the movement of the carrier structure 24 with the long-hair cutter unit 23 into one of the provided operating positions—see FIG. 7 and FIG. 8—namely, via a pivotally mounted control element 72 and the movably mounted push-rod 44 by actuation of the actuating switch 2 coupled with the push-rod 44.

Figure 2A:
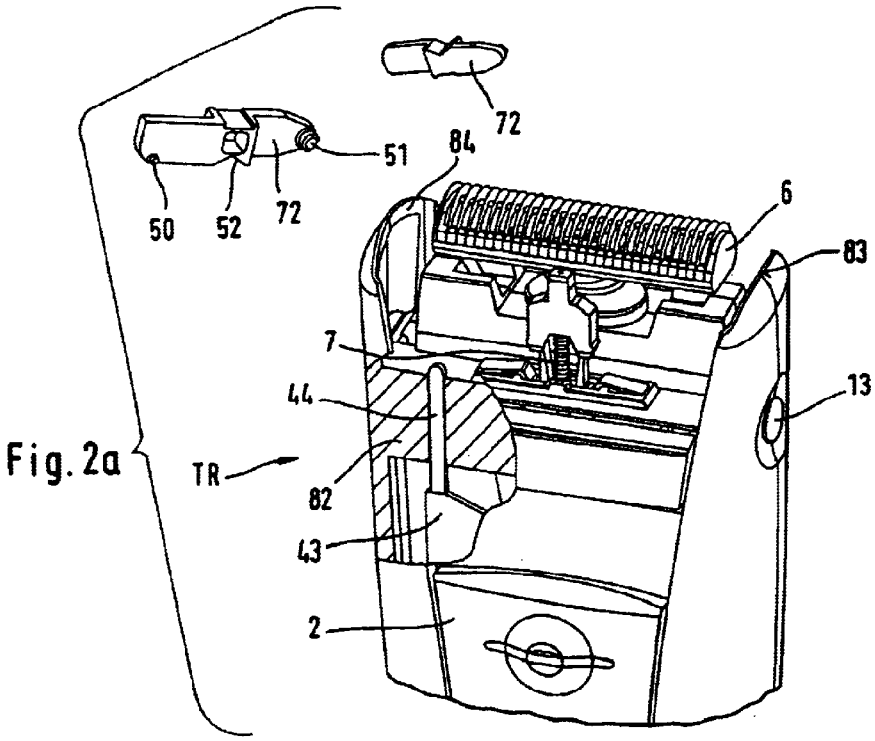
FIG. 2*a* is a perspective view of the control element of FIG. 2, showing the inner side thereof.

FIG. 2*a* shows the side of the control element 72 facing the carrier structure 24 in the mounted state. A control cam 50, 51 is integrally formed on each opposite end of the control element 72. The control element 72 is pivotally mounted by means of a wedge-shaped bearing 52 on an equally wedge-shaped support 47 provided on the inner wall of the shaving head frame 10 in order to move, by engagement of the control cam 51 in the slit shaped control element 42, the carrier structure 24 with the mounted long-hair cutter unit 23 in the direction of arrow A, in accordance with the movement of actuation of the actuating switch 2. The slit formed as the control element 42 in the wall 34 is arranged to extend in the longitudinal direction of the wall 34 in order to compensate for a horizontal component of motion of the control cam 51 of the pivotally mounted control element 72. The control element 41 is constructed as an arcuate groove whose arc shape is defined by the pivoting arc of the control cam 50 around the bearing structure 47/52 when the control cam is engaged in the groove.

Figure 5:
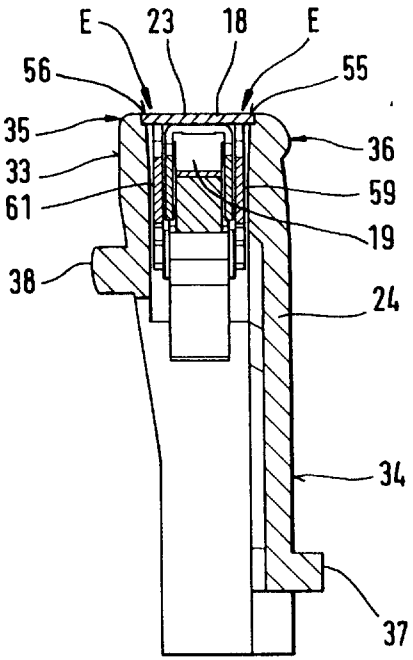
FIG. 5 is a sectional view of the long-hair cutter unit and the carrier structure.

FIG. 3 shows an embodiment of a shaving head 48 constructed as a long-hair cutter unit 23 with comb elements E protruding beyond the longitudinal side walls 59 and 61 of the outer cutter 18—see FIG. 5. In this embodiment the outer cutter 18 is comprised of a sheet metal part in which there are formed, as by stamping, a plurality of slits 53 and segments 55, 56, 57, 58 partly connecting said slits in further slits 54 extending in the longitudinal direction of the outer cutter 18. A pressing method is then employed for pressing the sheet metal part into a U-shape so that the segments 55, 56 extending transversely to the longitudinal direction of the outer cutter 18 protrude beyond the outer contour of the two longitudinal side walls 59 and 61 extending in an angled relationship to the wall element 60—see the sectional representation of FIG. 5.

The portions of the segments 55, 56 protruding beyond the longitudinal side walls 59, 61 act as the comb element E to thread the hairs into the cutting area of the outer cutter 18.

Furthermore, in the embodiment of FIG. 3 the relative arrangement and form of the slits 53 and 54 has been selected to form one segment 57 that extends in the wall element 60 in the longitudinal direction of the outer cutter 18 as well as several further segments 58 extending transversely to the segment 57 and coinciding with the U-shape of the outer cutter 18. The number of segments 58 varies from application to application depending on the stability of the outer cutter 18 required in the respective case and is not limited, therefore, to the number illustrated in FIG. 2.

In the embodiment illustrated in FIG. 3 there are provided, between every two segments 58 on either side of the segment 57, four segments 55 and 56 which, in the area of the oscillating inner cutter 19 engaging the outer cutter 18 under the action of the pressure spring 49, perform a cutting function, while their ends protruding as comb element E beyond the angled longitudinal side walls 59 and 61 perform a threading function during movement of the outer cutter 18 over the skin in the respective direction. To prevent skin irritations the skin-engaging edges of the segments 55 to 58, particularly those edges of the comb elements E formed by the segments 55 and 66, are rounded. The number of segments 55, 56 between two segments 58 is variable according to the stability required for the outer cutter 18.

The slits 54 bounded in the longitudinal side walls 59 and 61 by the respective segments 58 enable long hairs to enter the cutting area of the long-hair cutter unit 23 unhindered thanks to a threading operation performed by the comb elements E of the segments 55 and 56.

To assemble the shaving head of FIG. 3 to form a complete module, the pressure spring 49 is coupled with the coupling element 20. The inner cutter 19 is then secured to the coupling element 20 by means of a pin 64 and inserted into the interior of the U-shaped outer cutter 18. Using the holding elements 62, 63 abutting each against an end of the pressure spring 49 and acting therefore as support for this spring, the inner cutter 19, the pressure spring 49 and the coupling element 20 are united with the outer cutter 18 to form a module, with pins 65 to 68 which pass through the holding elements 62, 63 being securely joined to the longitudinal side walls 59 and 61 of the outer cutter 18, for example, by means of a welded joint. This ready-to-install module of a complete shaving head 48 is then inserted in the carrier structure 24 and secured there by means of the fastening elements 21 and 22. For this purpose the cross walls 25 and 26 joining the longitudinally extending walls 33 and 34 are provided with slits 70—see FIG. 4—in which the resilient fastening elements 21 and 22 of the long-hair cutter unit 23 are sprung in the course of mounting the long-hair cutter unit 23 in the carrier structure 24. This clip connection ensures simple mounting and demounting for replacement purposes.

Figure 4:
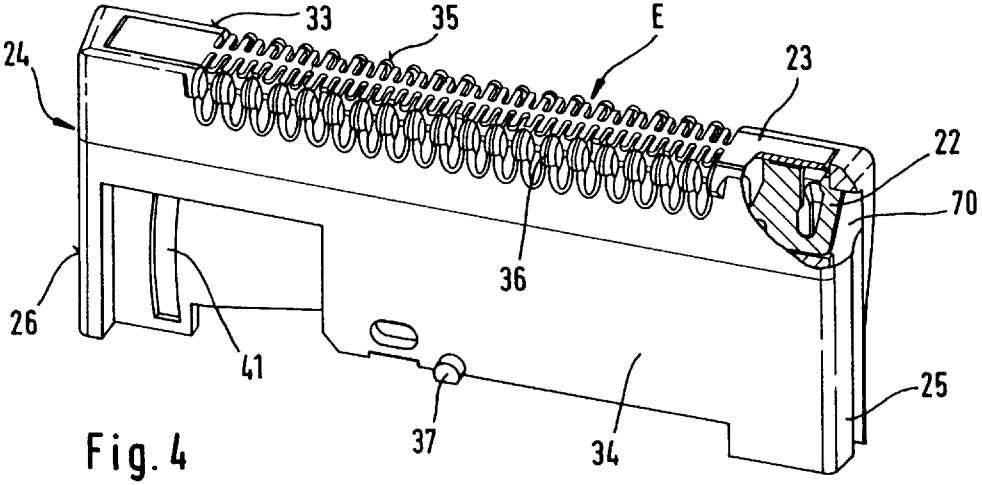
FIG. 4 is a perspective view of a carrier structure with internally arranged long-hair cutter unit and a partial sectional view of the fastening area of the long-hair cutter unit in the carrier structure.

In the embodiment of FIG. 4 the walls 33 and 34 of the carrier structure 24 are each constructed as a threader comb. The threader combs formed by the walls 33 and 34 are equipped with a relatively coarse comb tooth setting, that is, with a relatively large relative spacing of the individual comb teeth. By contrast, the outer cutter 18 of the long-hair cutter unit 23 has a close comb tooth setting of the comb elements E, that is, the individual comb teeth have a relatively small space in between. On account of the coarse tooth setting the comb elements 35 and 36 of the threader combs formed in the walls 33 and 34 are associated with only a few of the fine-toothed comb elements E of the outer cutter 18. The relative distance of two comb elements 36 and of two comb elements 35 is dimensioned such that at least one segment 55 or 56 or 58 of the comb elements E of the outer cutter 18 projects into this space.

FIG. 5 shows a cross section through a carrier structure 24 with a long-hair cutter unit 23 arranged inside. In this embodiment a comb element 35 and 36 is associated with the comb elements E protruding beyond the longitudinal side walls 59 and 61 of the outer cutter 18. The comb element 35 is formed integral with the wall 33, and the comb element 36 with the wall 34, so that the comb elements are located in front of the respective comb element E. The comb elements 35 and 36 are rounded in the area of their skin-engaging surfaces, effecting a smooth transition from the outer surfaces of the comb elements 35 and 36 of the carrier structure 24 to the comb elements E of the outer cutter 18. The inner cutter 19 of the long-hair cutter unit 23 is movably mounted inside the essentially U-shaped outer cutter 18 with its protruding comb elements E.

Figure 6:
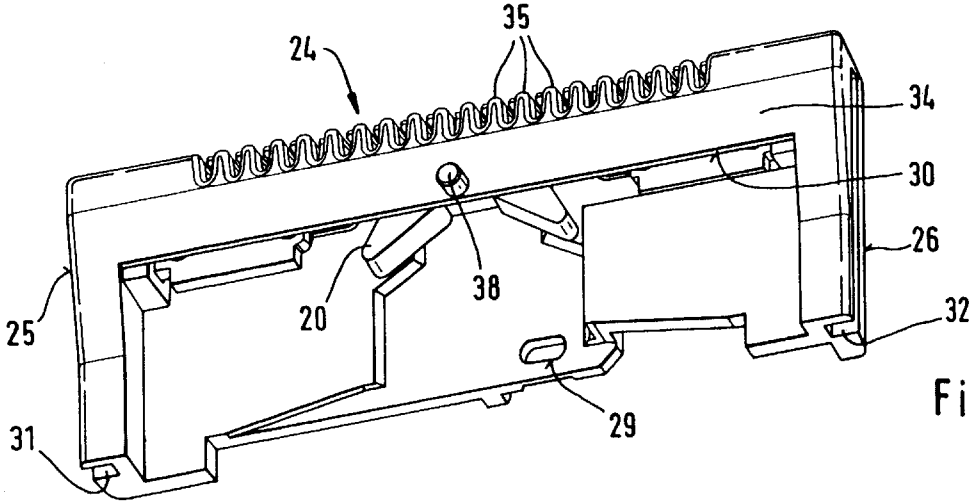
FIG. 6 is a perspective view of a carrier structure with built-in long-hair cutter unit and a coupling element of the inner cutter.

FIG. 6 shows a perspective representation of the carrier structure 24 and the long-hair cutter unit 23 of FIG. 4 and FIG. 5 as seen looking toward the wall 34 and the cross wall 25. The U-shaped cutout 30 provided in the wall 34 reveals the guide grooves 31, 32 formed in the cross walls 25, 26, the coupling element 20, the control cam 38, a control element 29 formed as a slit, and the comb elements 35 of the carrier structure 24. The U-shaped cutout 30 is conducive to a relatively close arrangement of the carrier structure 24 with built-in long-hair cutter unit 23 relative to the outer cutter 11 of the provided short-hair cutter unit K of the dry shaving apparatus TR—see FIG. 2.

Figure 7:
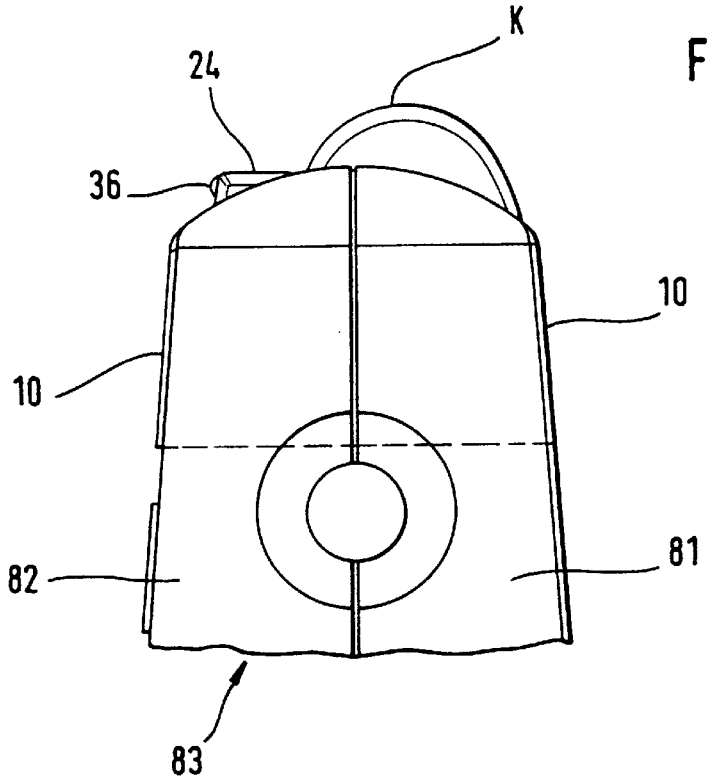
FIG. 7 is a side view of an end wall, a short-hair cutter unit and a carrier structure in a retracted position.
Figure 8:
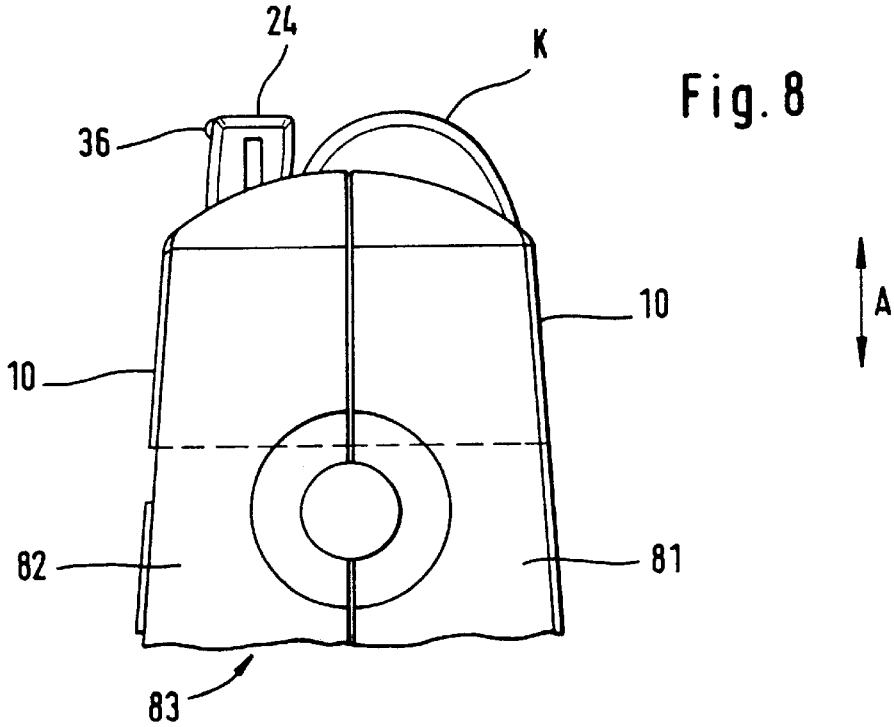
FIG. 8 is a side view of an end wall, a short-hair cutter unit and a carrier structure in an extended position.

FIG. 7 and FIG. 8 show each a side view of the upper part of the end wall 83 formed by the housing shells 81 and 82, and the shaving head frame 10 protruding beyond the outer contour of the end wall 83 and containing the provided short-hair cutter unit K and the carrier structure 24 with comb elements 36. In FIG. 7 the carrier structure 24 with the long-hair cutter unit 23 provided inside—not visible—occupies a retracted position relative to the higher lying cutting surface of the short-hair cutter unit K. In this position the long-hair cutter unit 23 can be switched on as well as off. The long-hair cutter unit 23 is preferably switched on in order to prevent single long hairs, which may get into the long-hair cutter unit 23, from becoming trapped there when using the activated short-hair cutter unit K.

In FIG. 8 the carrier structure 24 with the long-hair cutter unit 23 activated occupies an extended position lying at the same level or roughly the same level as the uppermost point of the surface of the short-hair cutter unit K. In this position, the carrier structure 24 with the long-hair cutter unit 23 arranged inside is mounted for floating movement.

What is claimed is:

1. A dry shaving apparatus comprising:

a housing;

a shaving head frame;

a single short-hair cutter unit accommodated in the shaving head frame;

a long-hair cutter unit of an essentially U-shaped configuration on one of the outer sides of the shaving head frame, and laterally adjacent to the single short-hair cutter unit, the long-hair cutter unit including a carrier structure, an outer cutter having slits defined between segments thereof and two longitudinal side walls, with comb elements protruding beyond the two longitudinal side walls, the outer cutter being movable in a vertical direction, and an associated inner cutter, wherein the dry shaving apparatus further comprises a threader comb having comb elements associated with the comb elements of the outer cutter, wherein the comb elements of the threader comb are movable jointly with the comb elements of the outer cutter in a vertical direction.

2. The dry shaving apparatus according to claim 1, wherein the threader combs equipped with comb elements are disposed on the carrier structure of the U-shaped outer cutter.

3. The dry shaving apparatus according to claim 1, wherein the long-hair cutter unit comprises a module removable as a unit from the carrier structure.

4. The dry shaving apparatus according to claim 1, wherein the carrier structure has two longitudinal walls extending parallel to each other and forming the comb elements of the threader comb.

5. The dry shaving apparatus according to claim 4, wherein the carrier structure also has cross walls which connect the two parallel longitudinal walls at their respective ends.

6. The dry shaving apparatus according to claim 4, wherein the long-hair cutter unit equipped with comb elements is disposed between the two parallel walls.

7. The dry shaving apparatus according to claim 1, wherein the carrier structure and the shaving head frame include cooperating guide elements to control the vertical mobility of the carrier structure and the long-hair cutter unit.

8. The dry shaving apparatus according to claim 1, further comprising a spring element and wherein the carrier structure is movable against the spring force of the spring element.

9. The dry shaving apparatus according to claim 8, further comprising an electric drive mechanism and a coupling element adapted to couple the electric drive mechanism with the inner cutter of the long-hair cutter unit, wherein the spring element is disposed in the coupling element.

10. The dry shaving apparatus according to claim 8, wherein the spring element is disposed between the carrier structure and the shaving head frame.

11. The dry shaving apparatus according to claim 1, wherein the comb elements of the threader comb have an outer contour that effects a smooth transition to the outer contour of neighboring comb elements of the long-hair cutter unit.

12. The dry shaving apparatus according to claim 11, wherein the comb elements of the threader comb are disposed underneath the comb elements of the outer cutter of the long-hair cutter unit.

13. The dry shaving apparatus according to claim 11, wherein the comb elements of the threader comb are positioned in front of the comb elements of the outer cutter of the long-hair cutter unit.

14. The dry shaving apparatus according to claim 1, wherein the comb elements of the threader comb have skin-engaging surfaces and are rounded off in the area of their skin-engaging surfaces.

15. The dry shaving apparatus according to claim 1, wherein the threader comb is equipped with a coarse comb tooth setting of the comb elements.

16. The dry shaving apparatus according to claim 1, wherein the outer cutter is equipped with a close comb tooth setting of the comb elements.

17. The dry shaving apparatus according to claim 1, wherein provision is made for the long-hair cutter unit to be switched on in two positions provided at relative opposite ends, and to be switched off in an intermediate position.

18. The dry shaving apparatus according to claim 1, wherein the long-hair cutter unit is floatingly mounted when in a position essentially coincidental with the height of the short-hair cutter unit.

19. The dry shaving apparatus according to claim 1, wherein the long-hair cutter unit is adapted to be switched on and locked in a position opposite to that of the short-hair cutter unit.

20. The dry shaving apparatus according to claim 1, further comprising a trimmer unit on the housing.

* * * * *